United States Patent [19]

Côté

[11] 4,130,132

[45] Dec. 19, 1978

[54] CONSTANT VOLUME REGULATOR WITH ADJUSTABLE LOAD MEANS

[75] Inventor: Anthony J. Côté, Shawbridge, Canada

[73] Assignee: E. H. Price Limited, Winnipeg, Canada

[21] Appl. No.: 780,964

[22] Filed: Mar. 24, 1977

[30] Foreign Application Priority Data

Aug. 31, 1976 [GB] United Kingdom ..... 35980/76

[51] Int. Cl.[2] ..... F16K 15/14; F16K 17/30

[52] U.S. Cl. ..... 137/512.15; 137/521; 251/DIG. 2; 236/49

[58] Field of Search ..... 137/521, 512.1, 512.5, 137/512.15, 625.28; 251/DIG. 2; 236/49, DIG. 1

[56] References Cited

U.S. PATENT DOCUMENTS

| | | | |
|---|---|---|---|
| 2,890,716 | 6/1959 | Werder | 137/521 X |
| 3,119,320 | 1/1964 | Batchelor | 137/625.28 X |
| 3,292,657 | 12/1966 | Reynolds | 137/512.15 |
| 3,942,552 | 3/1976 | Logsdon | 236/49 X |
| 3,967,779 | 7/1976 | Logsdon | 236/49 |

*Primary Examiner*—Arnold Rosenthal
*Attorney, Agent, or Firm*—Stanley G. Ade

[57] ABSTRACT

Air control regulators include automatically operated air curtains in which pressure and volume vary depending upon demand. A lever and fulcrum principle is used in this controller with the fulcrum position being variable. The fulcrum position can be adjusted manually or mechanically over a wide range of positions for each size of regulator and this variable location of the fulcrum varies the air flow rate through the regulator by re-positioning the flexible air curtain assembly within the regulator.

24 Claims, 4 Drawing Figures

CONSTANT VOLUME REGULATOR WITH ADJUSTABLE LOAD MEANS

BACKGROUND OF THE INVENTION

This invention relates to new and useful improvements in constant volume regulators for use in either single or dual duct air conditioning systems, said regulators being situated at each terminal unit in the system.

Conventionally, in variable volume systems both dual and single duct systems, changes in volume of air result in changes in pressure in the duct systems which effects individual units with regard to pressure and air flow.

Conventional regulators are provided with automatically operating flexible curtain assemblies in which the pressure and volume varies together depending upon the demands and variations in the system.

SUMMARY OF THE INVENTION

In the present device, one of the objects is to maintain a constant air flow rate within fixed limits over a wide range of air flow rates, regardless of the changes in pressure in the duct system and this constant volume device constitutes an improvement over existing methods of accomplishing this object and accomplishes the object to a far greater degree than heretofore.

One aspect of the invention constitutes the use of a lever and fulcrum principle with the fulcrum position being variable. The fulcrum can be adjusted either manually or mechanically over a very wide range of positions for each size of regulator and this variable location of the fulcrum varies the air flow rate through the regulator by re-positioning the flexible curtain assembly within the conventional perforated housing.

The device is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
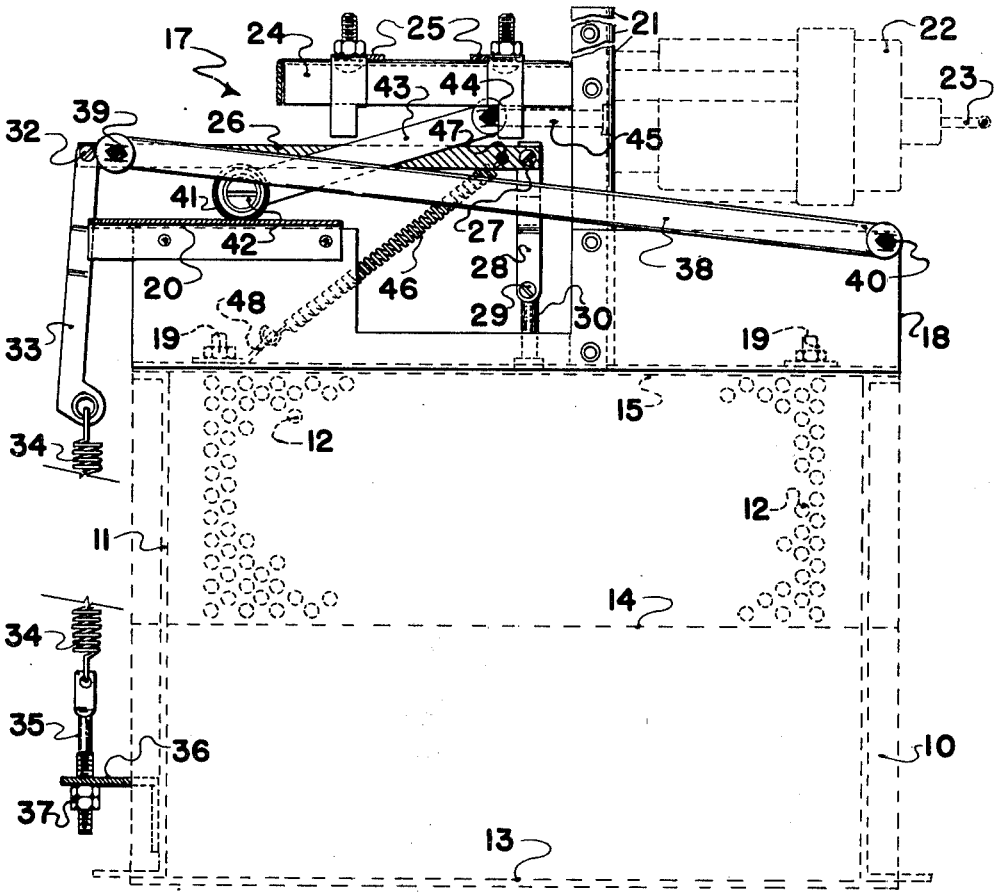
FIG. 1 is a typical side elevation of the preferred embodiment which is a reverse acting mechanism shown installed on a conventional volume regulator housing illustrated in phantom.

Proceeding therefore to describe the invention in detail, reference character 10 illustrates a typical volume regulator housing normally situated in the terminal end of a duct system (not illustrated).

The housing includes outwardly and downwardly diverging side plates 11 which are normally perforated as at 12 and air normally enters from the lower end 13 (with respect to the present drawings) and exits through the perforations 12 to be discharged in the usual way.

A pair of flexible curtains 14 are normally provided, pivoted adjacent the upper side 15 of the housing and normally being manufactured from neoprene or similar material. These can pivot outwardly or inwardly in the direction of double headed arrow 16, and control the volume of air passing through the housing, by means of the pressure generated by this air.

In the present device, these curtains are normally in the open position whereas in the direct acting cycle, these curtains are normally in the fully closed position.

The volume regulator control mechanism is collectively designated 17 and is situated on the upper side of the housing 10 (with reference to the present drawings).

A U-shaped mounting channel 18 is secured to this upper side by means of nut and bolt assemblies 19 and a track channel 20 is bolted over the upper ends of this channel 18 or secured as by rivets or any conventional means.

An actuator channel 21 is secured to the channel 18 intermediate the ends thereof and extends vertically upwardly, to carry, on one side thereof, a fulcrum positioning actuator 22 which is conventional and is air actuated through air connection point 23.

Extending at right angles upon the opposite side of channel 21, is a limit stop support 24 lying substantially parallel with channel 18 but spaced therefrom as clearly illustrated in FIG. 1.

A pair of limit stops 25 are secured to this support 24 and are movable therealong so that they may be clamped in the desired relationship one to the other, as will hereinafter be described.

Figure 2:
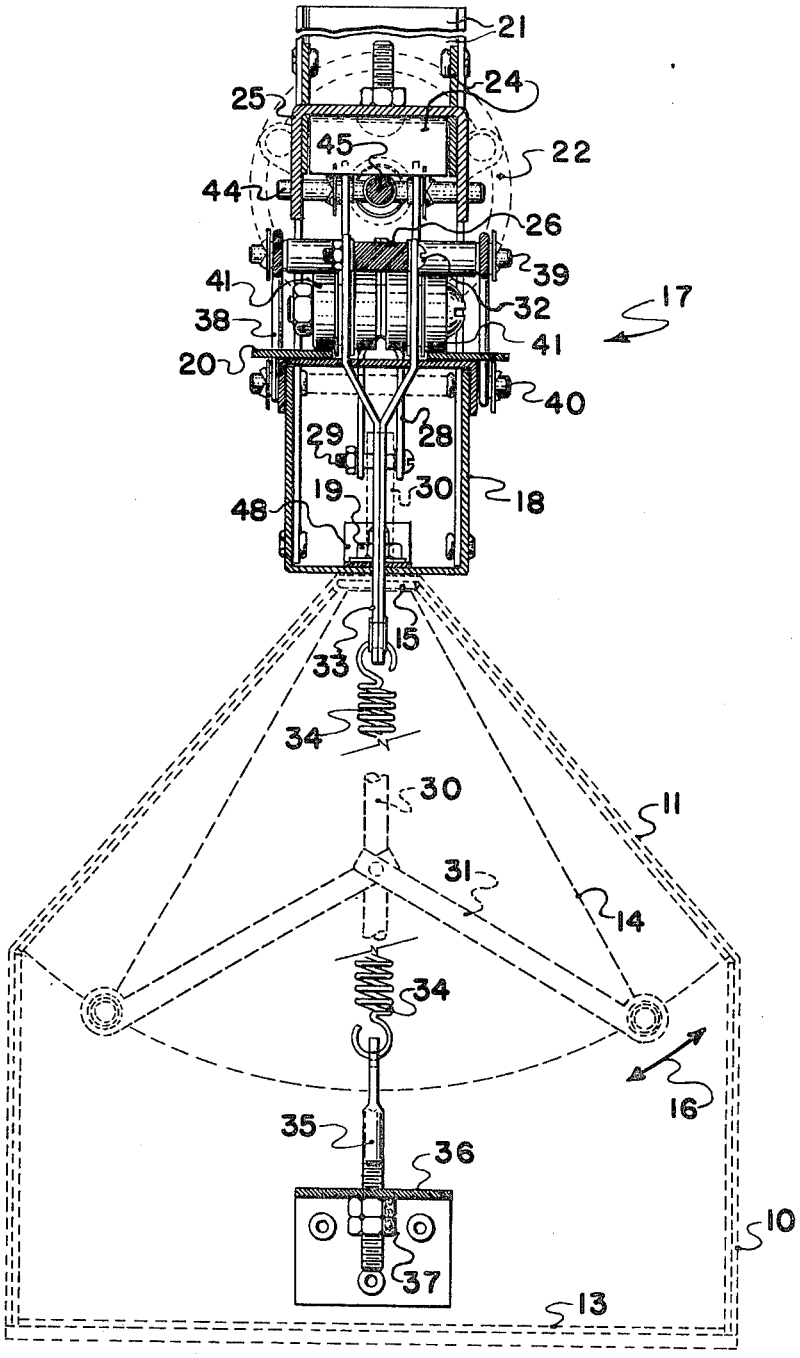
FIG. 2 is an end elevation of FIG. 1.

A main lever arm 26 is pivotally connected by one end thereof as by pivot connection 27, to the upper end of a lever arm regulator link 28 which in turn is pivotally connected by the lower end thereof as indicated by reference character 29, to the upper end of an actuating rod 30 operatively connected to the aforementioned curtains 14 for opening and closing same, it being understood that vertical movement of member 30 opens and closes the curtains 14 by means of the linkage 31 shown in FIG. 2.

The other end of lever arm 26 is pivotally connected as by pivot 32, to the upper end of lever arm spring link 33 to which the upper end of volume control spring 34 is secured as clearly illustrated. The lower end of spring 34 is in turn connected to a calibrating screw 35 extending through a fixed bracket 36 and adjusted by means of nuts 37 as clearly shown.

A pair of lever arms stabilizing bars 38 are pivotally secured one on each side of the lever arm 26 adjacent pivot point 32, and upon transverse pivot or retaining shaft 39 and the other ends of the stabilizing bars 38 are pivotally secured to adjacent the opposite of channel 18, by means of pivot or retaining shaft 40. A fulcrum assembly is provided for the lever arm 26 and takes the form of a fulcrum bearing or roller 41 mounted upon a fulcrum shaft 42 which in turn is secured to a pair of fulcrum bearing and actuating links 43 clearly illustrated in the drawings. An actuator link stop shaft 44 extends through the other ends of the link 43 and through the distal end of a plunger shaft 45 extending from the fulcrum point positioning actuator 22. This stop shaft engages the aforementioned limit stops 25 thus permitting end-shifting of the fulcrum bearing 41 therebetween, thereby changing the leverage action of the lever arm 26. Light tension springs 46 (FIG. 1) extend between pins 47 adjacent one end of the lever arm 26 and an anchoring point 44' within channel 18 as indicated by reference character 48 and act as regulator return springs.

These regulator return springs 46 ensure the positioning of the curtains 14 in the shut-off position under normal conditions and the lever arm stabilizing bars 38 stabilize the lever arm 26 at the outboard end and maintain the lever arm 26 in contact with the fulcrum bearing roller 41.

Figure 3:
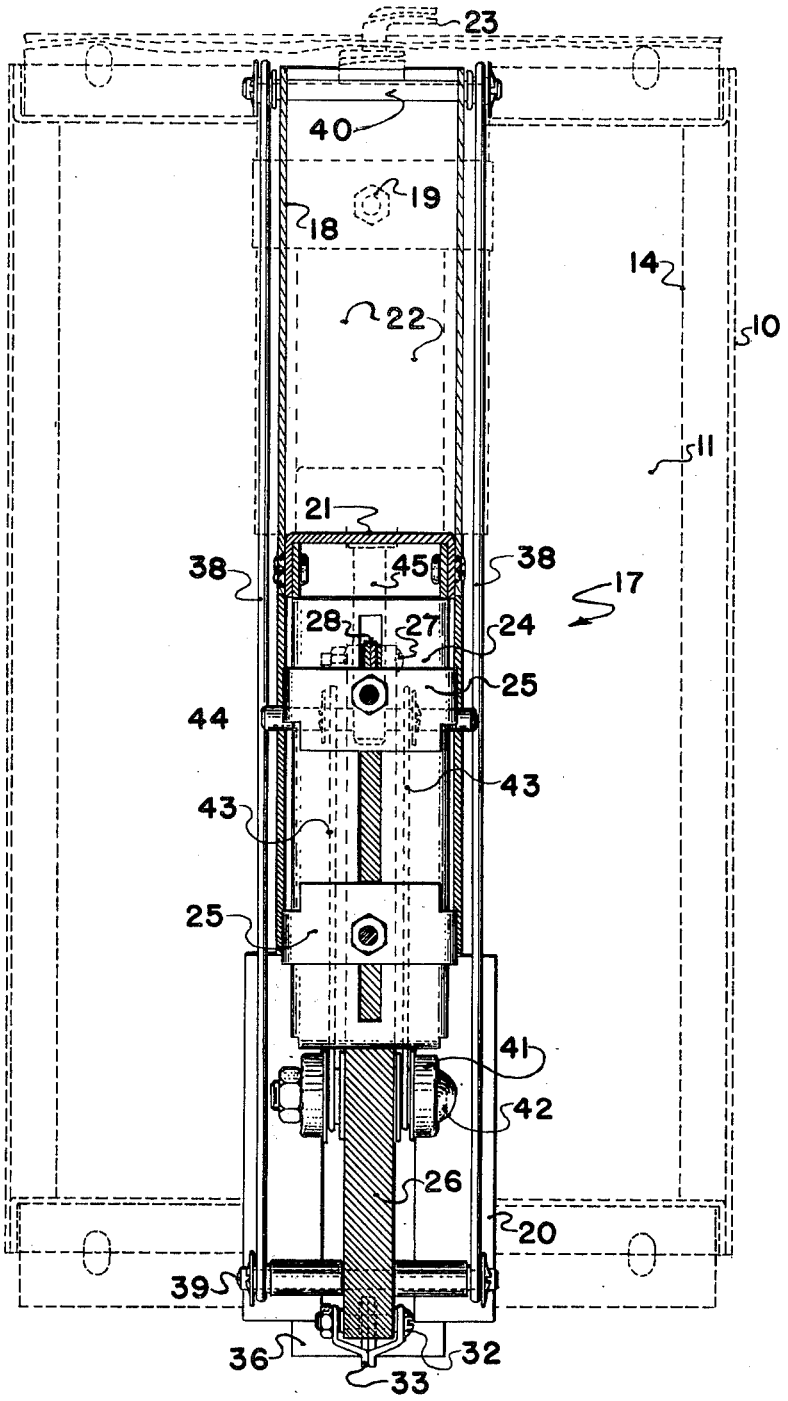
FIG. 3 is a top plan view of FIG. 1.

As mentioned previously, the control mechanism illustrated in FIGS. 1, 2 and 3 is for a reverse acting control cycle. In this control cycle, the regulator is normally open and provides the calibrated air flow rate. A re-positioning of the fulcrum point by means of the fulcrum bearing roller 41, causes the air flow rate to decrease to some minimum value or zero if full shut-off is required. However, with a direct acting control cycle illustrated partially in FIG. 4, the regulator is normally closed and there is no air flow. A re-positioning of the fulcrum point or roller bearing 41A, in this instance, opens the regulator and allows the air flow rate to increase up to the calibrated maximum flow rate or maximum capacity of the regulator.

Figure 4:
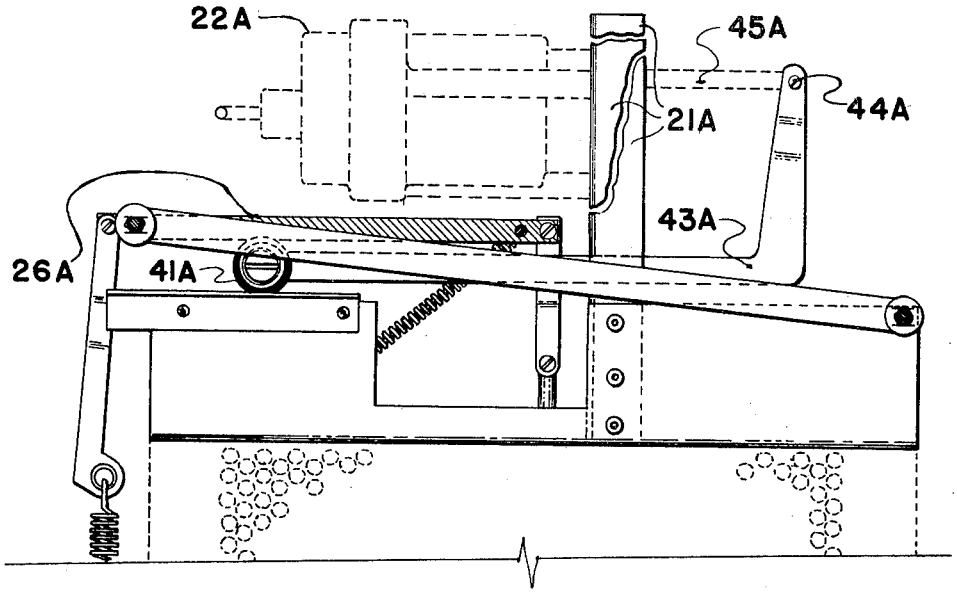
FIG. 4 is a fragmentary side elevation in reduced scale of a direct acting aspect of the present invention.

In FIG. 4 it will be noted that the actuator channel 21A has been reversed in position and that the fulcrum point positioning actuator 22 is situated on the opposite side to that illustrated in FIG. 1.

Under these circumstances, the fulcrum bearing and actuator links 43 are in the form of an angulated crank arm connected to the control shaft 45A as illustrated and being connected to the roller bearing 41A.

In FIG. 4, similar reference characters have been provided but also have been provided with the suffix "A" to distinguish them from the other views.

The regulator is calibrated on a test rig in the factory prior to installation. It is calibrated by adjusting the calibrating screw 35 and the adjusting nuts 37 until the specified air flow rate has been obtained and a CFM-calibration decal may then be mounted on the side of the limit stop support 24 and the limit stops 25 are located as required to the maximum and minimum positions. The regulator is then checked at various inlets static pressures to ensure that the air flow rate is within the allowable limits and following this, the regulator may be mounted in a terminal unit or regulator housing 10 in the usual way.

The control response instrument, in this embodiment, is a pneumatic thermostat (not illustrated) located in the space or zone being supplied with air from the air conditioning system. The flow rate of the air through the space is governed by the terminal unit or units each containing a constant volume regulator within the control mechanism as hereinbefore described. The room thermostat (not illustrated) would allow air pressure to pass through to the fulcrum point positioning actuator 22 when an increase in air flow is required or will bleed air off the actuator 22 when a decrease in air flow is required. This is with the direct acting control sequence. For a reverse acting sequence, the above operation is reversed.

The fulcrum point positioning actuator 22 is a pneumatic operator driven by compressed air normally not in excess of 20 psi. The actual operating pressure range is usually 5 psi. For example, a pneumatic operator will have an operating range of 5 to 10 psi or 8 to 13 psi. This means that at the lower pressure, the operator starts to move and at the higher pressure, the operator has completed its movement.

When the air pressure is removed from the pneumatic operator, there is an internal spring (not illustrated) which returns the operator to its normal starting position.

With a single duct air conditioning system supplying air to number of terminal units containing the constant volume regulator, the following operation takes place.

Under full load conditions, the terminal units supply the required amount of air to the spaces or zones being conditioned. One or more terminal units may be controlled by a single space thermostat and under full load conditions, the maximum air flow rate will be required from any terminal unit and the thermostat will pass full control air pressure through to the fulcrum point positioning actuator 22 in the terminal unit which will position the fulcrum point to adjust the curtain assembly 37 to allow the required air flow rate.

As the load conditions in the space are reduced, the space thermostat will sense this change and will bleed air off the fulcrum point positioning actuator 22 thus re-positioning the fulcrum point and furthermore adjusting the position of the curtain assembly 14 to reduce the air flow rate through the regulator.

This re-positioning of the fulcrum and curtain assembly will continue in response to the control pressure from the pneumatic thermostat as the air conditioning load varies in the space.

It can be seen that, with a number of terminal units going through the above cycling, a variation in air flow rate and pressure in the duct system will occur.

Where these variations in air pressure occur at individual terminal units, the control mechanism will allow the curtain assembly 14 to react to these pressure variations and where the pressure is reduced, the curtain assembly 14 will open to allow the required amount of air to pass.

However, where the pressure is increased, the curtain assembly will react to this increase in duct pressure and will close off to maintain the required air flow rate. The curtain assembly 14 will respond continuously to these pressure variations to maintain a constant air flow rate at any position of the fulcrum, within fixed limit variations decided upon by design parameters.

This control mechanism can be applied to terminal units containing reheat coils whereby the control mechanism, can be made to operate in sequence with the demand for heat from the reheat coils (not illustrated). With a reheat coil, the normal sequence of operation is to reduce the air flow rate to some minimum value before the reheat coils come into operation.

In a dual duct system, it is assumed that an air conditioning system consists of two ducts, one duct supplying cold air and the other duct supplying warm air and connected to a number of terminal units containing the constant volume regulator. However, as such air conditioning systems are well known, details of the ducting is not shown in the present application.

The changing demands for air in the spaces or zones will cause pressure variations in the ducts with resultant variations in volume flowing through the ducts. In dual duct systems the flow in the cold and warm air ducts may vary over wide ranges in response to demands in the spaces or zones and therefore may result in wide variations of pressure. The constant volume regulator will respond in a similar manner to that hereinbefore described for single duct systems, in order to maintain a constant air flow rate despite variations in pressure.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A control volume regulator for use with air supply systems which include at least one terminal unit having a volume regulator housing and a flexible curtain control assembly situated in said housing and a source of control air for said regulator; the improvement comprising in combination an actuating rod for said flexible curtain control assembly, operatively connected thereto, means to control the range of movement of said curtain, said means including supporting structure, a lever arm pivotally connected by one end thereof to said actuating rod, fulcrum means on said supporting structure, supporting said lever arm and adjustable load means operatively connected to the other end of said lever arm, said adjustable load means including a tension spring extending between said other end and an anchor point, and means to adjust the tension in said spring.

2. The invention according to claim 1 which includes at least one stabilizing bar pivoted by one end thereof to said supporting structure and by the other end thereof to adjacent said other end of said lever arm.

3. The invention according to claim 1 in which said fulcrum means is adjustable within limits relative to said lever arm thereby controlling the leverage characteristics of said lever arm and hence the controlling effect of said adjustable load means, upon the operation of the flexible curtain control assembly or the like within said housing.

4. The invention according to claim 2 in which said fulcrum means is adjustable within limits relative to said lever arm thereby controlling the leverage characteristics of said lever arm and hence the controlling effect of said adjustable load means, upon the operation of the flexible curtain control assembly or the like within said housing.

5. The invention according to claim 3 which includes means to adjust the position of said fulcrum means and further means to limit said adjustment, said last mentioned means including a pair of adjustable stop members selectively and clampably mounted for movement on said supporting structure, and means cooperating between said fulcrum means and said stop members.

6. The invention according to claim 4 which includes means to adjust the position of said fulcrum means and further means to limit said adjustment, said last mentioned means including a pair of adjustable stop members selectively and clampably mounted for movement on said supporting structure, and means cooperating between said fulcrum means and said stop members.

7. The invention according to claim 5 in which said fulcrum means includes a roller assembly, a roller track on said supporting structure upon which said roller assembly is mounted for endwise rolling movement therealong, an actuating link, said roller assembly being journalled for rotation within one end of said actuating link, said means cooperating between said fulcrum means and said stop members, being mounted on the other end of said actuating link.

8. The invention according to claim 6 in which said fulcrum means includes a roller assembly, a roller track on said supporting structure upon which said roller assembly is mounted for endwise rolling movement therealong, an actuating link, said roller assembly being journalled for rotation within one end of said actuating link, said means cooperating between said fulcrum means and said stop members, being mounted on the other end of said actuating link.

9. The invention according to claim 5 which includes control means for moving said fulcrum means between said stop members, said control means including an air actuated fulcrum point position actuator operatively connected to the source of control air.

10. The invention according to claim 6 which includes control means for moving said fulcrum means between said stop members, said control means including an air actuated fulcrum point position actuator operatively connected to the source of control air.

11. The invention according to claim 7 which includes control means for moving said fulcrum means between said stop members, said control means including an air actuated fulcrum point position actuator operatively connected to the other end of said actuator link.

12. The invention according to claim 8 which includes control means for moving said fulcrum means between said stop members, said control means including an air actuated fulcrum point position actuator operatively connected to the other end of said actuator link.

13. A control volume regulator for use with air supply systems which include at least one terminal unit having a volume regulator housing and a flexible curtain control assembly situated in said housing and a source of control air for said regulator; the improvement comprising in combination an actuating rod for said flexible curtain control assembly, operatively connected thereto, means to control the range of movement of said curtain, said means including supporting structure, a lever arm pivotally connected by one end thereof to said actuating rod, fulcrum means on said supporting structure, supporting said lever arm and adjustable load means operatively connected to the other end of said lever arm, said fulcrum means being adjustable within limits relative to said lever arm thereby controlling the leverage characteristics of said lever arm and hence the controlling effect of said adjustable load means, upon the operation of the flexible curtain control assembly or the like within said housing.

14. The invention according to claim 13 which includes means to adjust the position of said fulcrum means and further means to limit said adjustment, said last mentioned means including a pair of adjustable stop members selectively and clampably mounted for movement on said supporting structure, and means cooperating between said fulcrum means and said stop members.

15. The invention according to claim 14 in which said fulcrum means includes a roller assembly, a roller track on said supporting structure upon which said roller assembly is mounted for endwise rolling movement therealong, an actuating link, said roller assembly being journalled for rotation within one end of said actuating link, said means cooperating between said fulcrum means and said stop members, being mounted on the other end of said actuating link.

16. The invention according to claim 14 which includes control means for moving said fulcrum means between said stop members, said control means including an air actuated fulcrum point position actuator operatively connected to the source of control air.

17. The invention according to claim 15 which includes control means for moving said fulcrum means between said stop members, said control means including an air actuated point position actuator operatively connected to the other end of said actuator link.

18. The invention according to claim 13 in which said adjustable load means includes a tension spring extending between said other end and an anchor point, and means to adjust the tension in said spring.

19. The invention according to claim 18 in which said adjustable load means includes a tension spring extending between said other end and an anchor point, and means to adjust the tension in said spring.

20. A control volume regulator for use with air supply systems which include at least one terminal unit having a volume regulator housing and a flexible curtain control assembly situated in said housing and a source of control air for said regulator; the improvement comprising in combination an actuating rod for said flexible curtain control assembly, operatively connected thereto, means to control the range of movement of said curtain, said means including supporting structure, a lever arm pivotally connected by one end thereof to said actuating rod, fulcrum means on said supporting structure, supporting said lever arm and adjustable load means operatively connected to the other end of said lever arm, said adjustable load means including a tension spring extending between said other end and an anchor point, and means to adjust the tension in said spring, including at least one stabilizing bar pivoted by one end thereof to said supporting structure and by the other end thereof to adjacent said other end of said lever arm, said fulcrum means being adjustable within limits relative to said lever arm thereby controlling the leverage characteristics of said lever arm and hence the controlling effect of said adjustable load means, upon the operation of the flexible curtain control assembly or the like within said housing.

21. The invention according to claim 20 which includes means to adjust the position of said fulcrum means and further means to limit said adjustment, said last mentioned means including a pair of adjustable stop members selectively and clampably mounted for movement on said supporting structure, and means cooperating between said fulcrum means and said stop members.

22. The invention according to claim 21 in which said fulcrum means includes a roller assembly, a roller track on said supporting structure upon which said roller assembly is mounted for endwise rolling movement therealong, an actuating link, said roller assembly being journalled for rotation within one end of said actuating link, said means cooperating between said fulcrum means and said stop members, being mounted on the other end of said actuating link.

23. The invention according to claim 21 which includes control means for moving said fulcrum means between said stop members, said control means including an air actuated fulcrum point position actuator operatively connected to the source of control air.

24. The invention according to claim 22 which includes control means for moving said fulcrum means between said stop members, said control means including an air actuated fulcrum point position actuator operatively connected to the other end of said actuator link.

* * * * *